US005367733A

United States Patent [19]

Zeiler

[11] Patent Number: 5,367,733

[45] Date of Patent: Nov. 29, 1994

[54] METHOD AND APPARATUS FOR LIQUID DEFLECTION

[75] Inventor: Bernhard Zeiler, Spartanburg, S.C.

[73] Assignee: Milliken Research Corporation, Spartanburg, S.C.

[21] Appl. No.: 206,874

[22] Filed: Mar. 4, 1994

Related U.S. Application Data

[62] Division of Ser. No. 876,493, Apr. 30, 1992, Pat. No. 5,331,829.

[51] Int. Cl.[5] ..... D06B 1/02

[52] U.S. Cl. ..... 8/149.1; 8/151

[58] Field of Search ..... 68/205 R, 13 R, 620, 68/200; 8/151, 158, 149.1, 149.2, 151.2

[56] References Cited

U.S. PATENT DOCUMENTS

| | | | |
|---|---|---|---|
| 2,584,650 | 2/1952 | Woodruff | 126/113 |
| 3,570,275 | 3/1971 | Weber et al. | 68/205 |
| 3,614,880 | 10/1971 | Bayne | 68/205 |
| 3,935,979 | 2/1976 | Hickey | 226/19 |
| 3,942,343 | 3/1976 | Klein | 68/205 |
| 3,969,779 | 7/1976 | Stewart, Jr. | 8/149 |
| 3,978,695 | 9/1976 | Hurzeler et al. | 68/20 |
| 4,034,584 | 7/1977 | Klein et al. | 68/205 |
| 4,555,416 | 11/1985 | Fights et al. | 427/248.1 |
| 4,624,023 | 11/1986 | Fleissner | 8/151 |
| 4,923,743 | 5/1990 | Stewart, Jr. | 427/288 |
| 4,987,001 | 1/1991 | Knobbe et al. | 427/28 |
| 4,993,242 | 2/1991 | Poor | 68/13 |

*Primary Examiner*—Frankie L. Stinson

*Attorney, Agent, or Firm*—Kevin M. Kercher; Terry T. Moyer

[57] ABSTRACT

This invention relates to a method and apparatus for liquid deflection for liquid spray generators utilized in impressing marking materials (e.g., dyes, inks, paints, coatings) onto substrates (e.g., fabric) and, more particularly, to a mechanism for producing a plurality of aligned streams of atomized droplets to produce a pattern on a substrate. A constant air supply is utilized with a liquid marking material line which is low enough to prevent diverting of the stable liquid stream but high enough to keep the air orifice free of liquid. Shields are also utilized to prevent the liquid mist accumulation from accidently getting on the substrate to be treated.

13 Claims, 6 Drawing Sheets

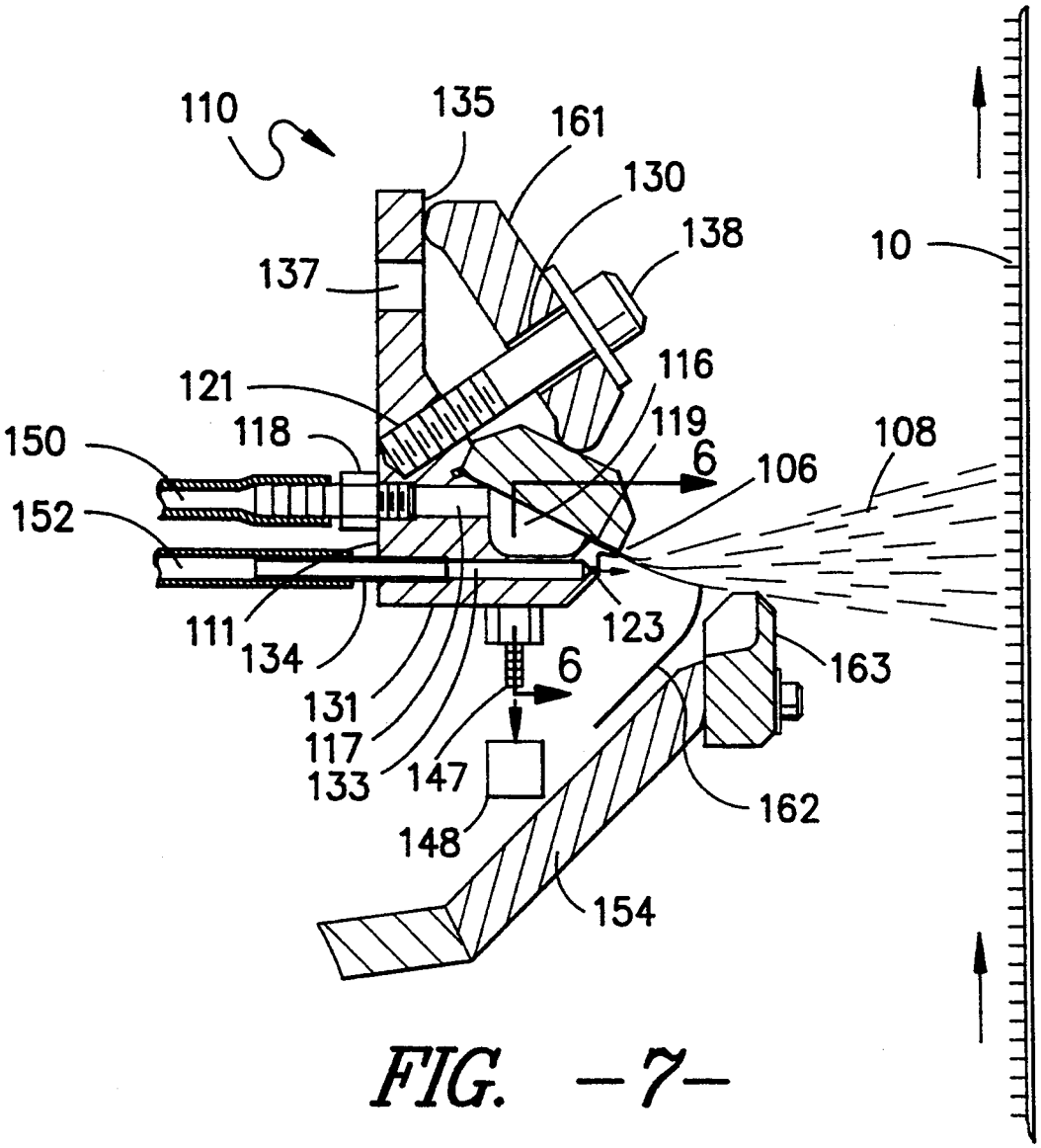
FIG. —7—

METHOD AND APPARATUS FOR LIQUID DEFLECTION

This is a divisional application of patent application Ser. No. 07/876,493, filed Apr. 30, 1992, now U.S. Pat. No. 5,331,829.

BACKGROUND OF THE INVENTION

This invention relates to a method and apparatus for liquid deflection for liquid spray generators utilized n impressing marking materials (e.g., dyes, inks, paints, coatings) onto substrates (e.g., fabric) and, more particularly, to a mechanism for producing a plurality of aligned streams of atomized droplets to produce a dye pattern on a substrate. This apparatus includes several arrays of closely spaced streams of marking material that are normally directed into corresponding collection surfaces or receptacles. Each stream in a given array has associated with it a source of pressurized air or other control fluid which, on command, forms and directs an atomizing control fluid stream into contact with the marking material whereby the stream of marking material is transformed into a mist of variously sized diverging droplets that are propelled in the direction of the substrate to be marked. By interrupting the streams of atomizing fluid in oscillatory fashion, uniform reproduction of various solid color or multi-hued patterns is possible. By employing such controlled pulsations, the marking material sources, directing fluid sources, substrate, droplet size distribution and the degree of droplet dispersion can be carefully controlled, yielding intricate patterns possessing great subtlety, delicacy, and variety that may be produced with a high degree of reproducibility. By providing for the nonsimultaneous actuation of adjacent atomizing fluid streams along a given array, a wide variety of side to side or fill direction patterns may be produced.

One of the major problems with this type of technology is the inadvertent misdirection of liquid, e.g., dye, into the air orifice and associated air lines and onto the substrate and other parts of the apparatus. Dye can wick into the air orifice as it runs past. This occurs when the dye speed through the orifice is too low to maintain a stable dye stream. Low dye flow occurs at the start-up, shut down or whenever a dye orifice is partially plugged. Furthermore, dye can mist and form droplets and then drip onto the substrate to be treated.

The present invention solves these problems in a manner not disclosed in the known prior art.

SUMMARY OF THE INVENTION

This invention relates to a method and apparatus for liquid deflection for liquid spray generators utilized in impressing marking materials (e.g., dyes, inks, paints, coatings) onto substrates (e.g., fabric) and, more particularly, to a mechanism for producing a plurality of aligned streams of atomized droplets to produce a pattern on a substrate. A constant air supply is utilized with a liquid marking material line that is low enough to prevent diverting of the stable liquid stream but high enough to keep the air orifice free of liquid. Shields are also utilized to control mist collection on the printing hardware and the subsequent runoff so as to prevent the runoff from dripping onto the fabric.

It is an advantage of this invention to utilize air pressure to prevent dye from wicking into an air orifice as it runs past by constantly outputting air while not unintentionally affecting the primary liquid marking material stream.

Still another advantage of this invention is the utilization of a shielding to prevent marking material liquid from inadvertently forming into droplets and striking the substrate.

Another advantage of this invention is that the use of constant air flow to prevent liquid marking material clogging that eliminates the need for ancillary peripheral devices and merely modifies the current air flow system.

A further advantage of this invention is the use of shielding is a very inexpensive and effective means of obviating droplet formation developed from liquid marking material mist.

Yet another advantage of this invention is the controllable collection mechanism that directs mist away from the substrate and out of the print zone.

In another advantage of this invention is that air is used to keep marking material mist out of the electronic circuitry utilized with the valves by creating a slightly higher pressure in the electronic enclosure associated therewith.

Still another advantage of this invention is the shielding reduces the need for extensive cleaning of difficult to clean components of the present invention.

These and other advantages will be in part apparent and in part pointed out below.

BRIEF DESCRIPTION OF THE DRAWINGS

The above as well as other objects of the invention will become more apparent from the following detailed description of the preferred embodiments of the invention when taken together with the accompanying drawings, in which:

FIG. 7 is a cross-section of the embodiment of FIG. 5 taken along lines 7—7 of FIG. 5.

DETAILED DESCRIPTION OF THE PREFERRED EMBODIMENT

Figure 1:
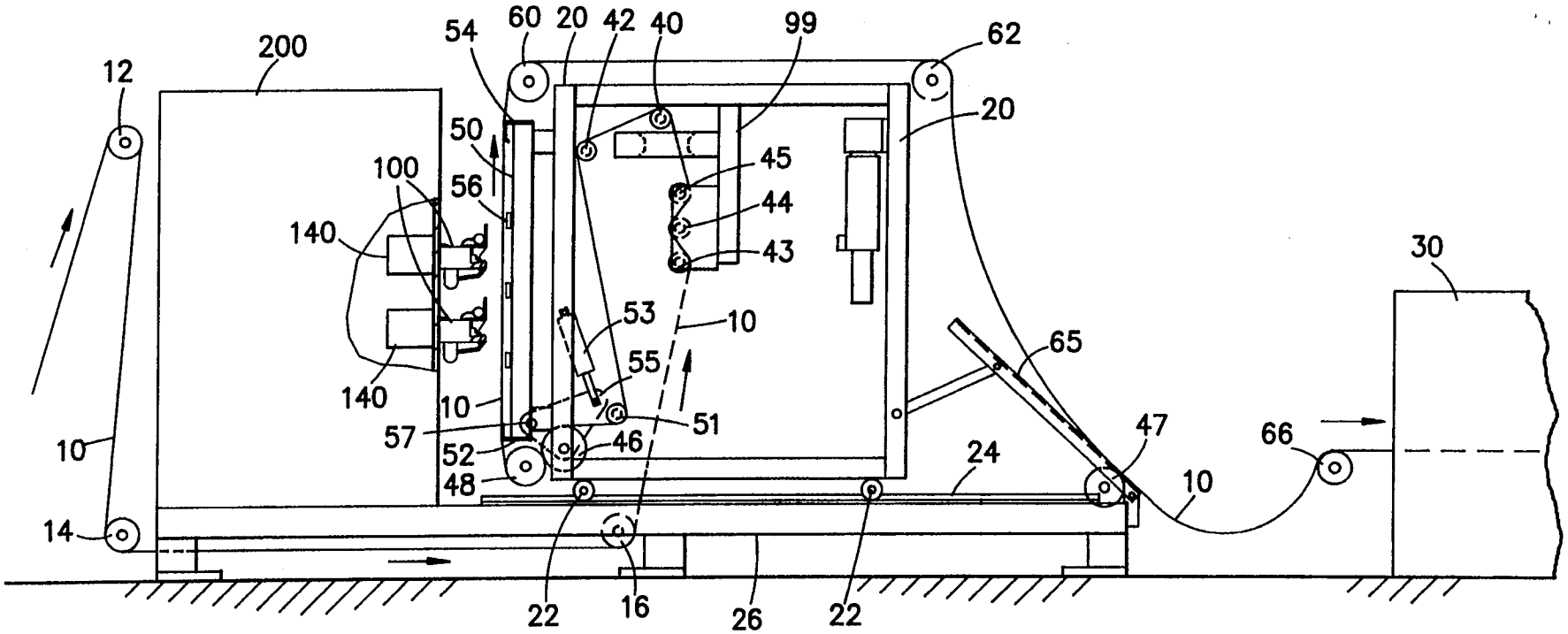
FIG. 1 schematically depicts an elevational view of an apparatus embodying the invention which may be used to prevent the inadvertent misdirection of patterning liquid, e.g., dye, into the air orifice and associated air lines, and onto the substrate and other parts of the apparatus.

Referring more specifically to the Figures, FIG. 1, shows diagrammatically, an overall side elevation-view of apparatus suitable for patterning a web of moving substrate and preventing the inadvertent dispersion of liquid in accordance with the teachings herein. The embodiments depicted and described below in connection with FIGS. 1, 2, 3, 3A, 4, 4A, 5, 6 and 7 use dye as the marking material and air as the control fluid. Although certain components are referred to with respect to air or dye, it is understood that those same components would be used for other control fluids and marking materials, respectively. While any substrate material capable of being dyed or otherwise patterned by the procedures set forth below may be used, a preferred material is a textile substrate such as fabric or carpet in web form. Substrate 10 is supplied from any suitable source, and is drawn over idler rolls 12, 14 and under valve house 200 to idler roll 16, which rotates in bearings associated with platform 26. Substrate 10 is then directed into the interior of rolling frame 20, which is supported on wheels 22 and which may be moved along track 24 to adjust the distance between rolling frame 20 and valve house 200 and, correspondingly, between an array 100 of spray generators for marking material and the face of the substrate 10. This permits the effects of changing the spacing between the array 100 of spray generators and the face of the substrate 10 to be easily and immediately observed. The rolling frame 20 is manually moved by the handcrank 47.

Substrate 10 is directed around guide rolls 43, 44, and 45, respectively that are a part of an Erhardt & Liemer GmbH ® fabric guider and position sensor 99 manufactured in West Germany and then around idler rolls 40, 42 and scroll roll 51 and through idling nip roll 46 and driven nip roll 48. Idling nip roll 46 is attached to triangular member 55. Triangular member 55 is pivotally attached to rolling frame 20 by means of pin 57. Idling nip roll 46 can disengage driven nip roll 48 by means of a pneumatic cylinder 53 that is attached to the rolling frame 20 at one end and the triangular member 55 at the other.

The substrate 10 is then presented, in a preferred embodiment, in a substantially vertical orientation to the array 100 of spray generators mounted on the face of the valve house 200 that encloses air control valves 140. As shown in FIG. 1, in the preferred embodiment, the substrate 10 may be separated from the appropriate backing member 50, which may be comprised if plastic or other dye-impervious material, by spacers 52, 54 positioned along the top and bottom edges of backing member 50 above and below the level of the array 100, and by intermediate spacers 56 located between spacers 52 and 54, thereby assuring no contact between the back of substrate 10 and the backing member 50. This prevents unwanted smearing on the back of the substrate 10 such as fabric and prevents excessive saturation or accumulation of dye visible on the face of the substrate 10. In a particular preferred embodiment, lower spacer 52 may be in the form of a trough-like collector which can serve to collect the sprayed liquid which may pass through substrate 10 and collect on backing member 50 or which may spray beyond the substrate edges and collect on backing member 50.

Substrate 10 is then directed over tension-generating rolls 60 and 62. Both tension generating rolls 60, 62 may have their surfaces covered with rubber or the like and may be overdriven, to assure that substrate 10 is relatively taut in the region opposite array 100. As shown, substrate 10 may then be guided by a fabric deflector 65 over idler roll 66 to an appropriate dye fixation means 30 or other post treatment processor.

Figure 2:
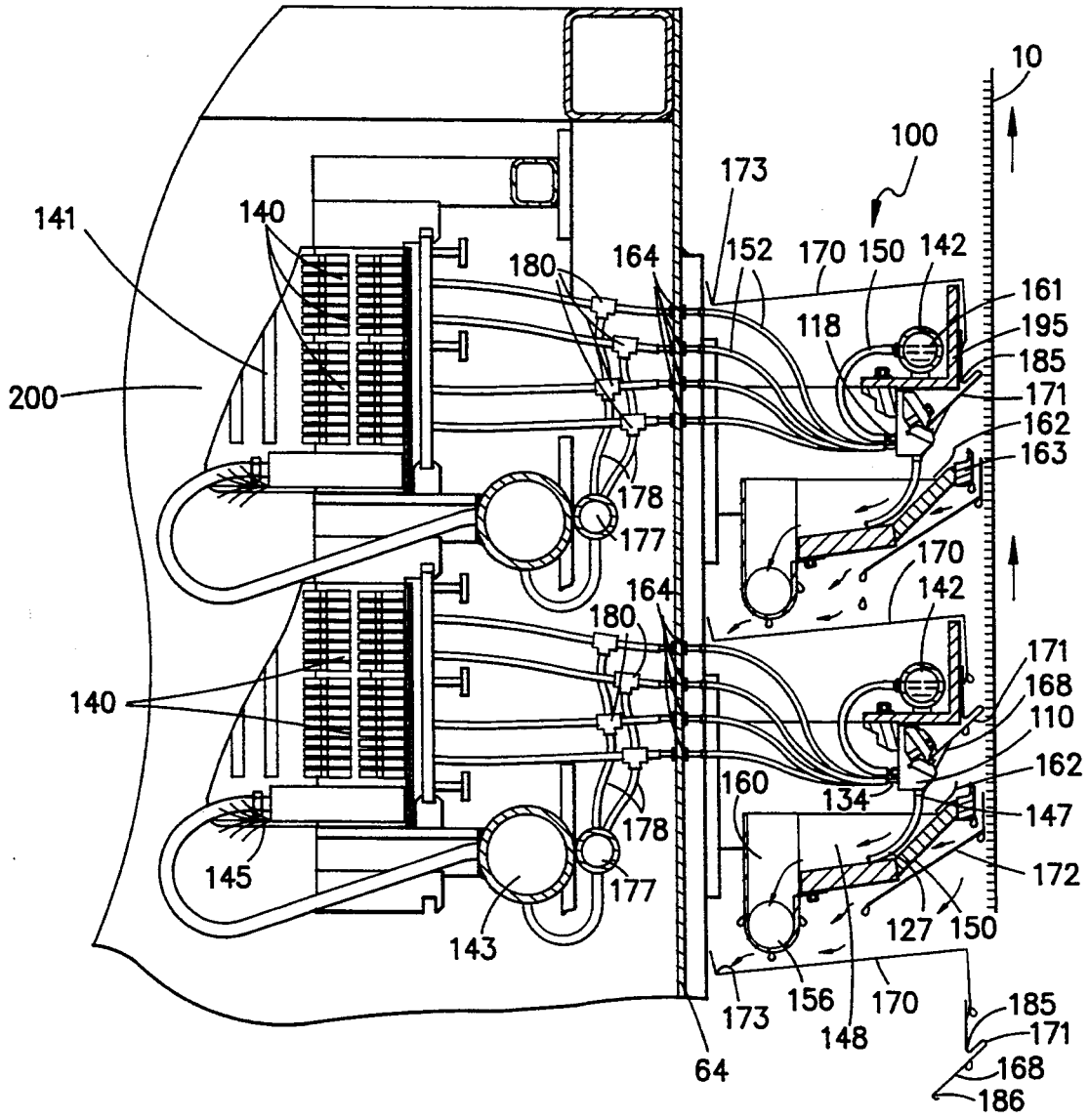
FIG. 2 is a sectional view through two rows of single piece modules, utilizing an apparatus to prevent the inadvertent misdirection of patterning liquid.

FIG. 2 illustrates a preferred embodiment of the array of spray generators of the type depicted by numeral 100 in FIG. 1. There is a single piece module 110 that has air supply passages 133 bored therethrough as shown in FIGS. 3, 3A, 4, 4A, 6 and 7. Air supply passages 133 have air exit orifices 123 at one end and air fittings 134 at the other end, for connecting to air conduits or hoses 152, as shown in FIGS. 3, 3A, 4 and 4A. The air fitting 134 is preferably a stainless steel tube of a slightly larger diameter than the air conduit 152 inside diameter for a fluid tight interconnection. The air fitting 134 is seated into module 110 such that its inside diameter is the same as the air passage diameter 133. This requires a counter bore in the module 110 equal to the air fitting 134 outside diameter to seat the fitting. The air fitting 134 is glued into this counterbore and the module 110 is peened to hold the air fitting 134 in the module 110 and to create an air tight seal. The air conduits 152 are in fluid communication with the air supply passages 133 formed in module 110. The other ends of air conduits 152 are connected to fittings 164 in front wall 64 which, via additional suitable conduits, are ultimately connected to air control valves 140, as can best be shown in FIG. 2. Air control valve 140, controls the air delivered from air manifold source 143.

As can best be seen in FIG. 7, the air exit orifices 123 of air supply passages 133 are arranged to provide jets of air under pressure that intersect the dye stream 106 and break the dye stream 106 into a dye spray 108 and direct the dye spray 108 onto the moving substrate 10. Air control valve 140 controls the delivery of air, through air conduits 152 according to a preselected pattern. Bursts of air according to the pattern cause the dye spray 108 to impact on the substrate 10 and form the desired pattern. The dye forming the dye stream 106 is supplied by a dye supply manifold 142 via external dye conduit 150 to dye supply fittings 118 for fluid connection into the single piece module 110 as shown in FIG. 2. As can be seen in FIGS. 3 through 7, a trough 116, extending generally longitudinally almost the entire length of module 110, has a depth sufficient to hold and supply dye for spraying. Trough 116 has an open portion extending the entire length and width of the trough. Dye supply conduits 117 (diameter 0.159 inches) extend from the back surface of trough 116 and are fitted with dye supply fittings 118 for fluid communication with the rear wall 111 of the module 110. Threaded fitting 118 provides a means for connecting dye conduits 117 to external dye conduits 150, which in turn are connected to the dye supply manifold 142, as shown in FIGS. 2 and 7. As can best be seen in FIGS. 3, 3A, 4, 4A and 5, upper planar surface 112 of single piece module 110 has dye grooves 119 which extend from trough 116 to the dye orifices 120 on the front surface 113 of single piece module 110, forming a path for dye flow from trough 116 to dye orifice 120. Dye grooves 119 are longitudinally spaced along single piece module 110 at intervals of about 0.200 inch, with each groove 119 having the same predetermined uniform cross-sectional area, in the preferred embodiment.

Figure 3:
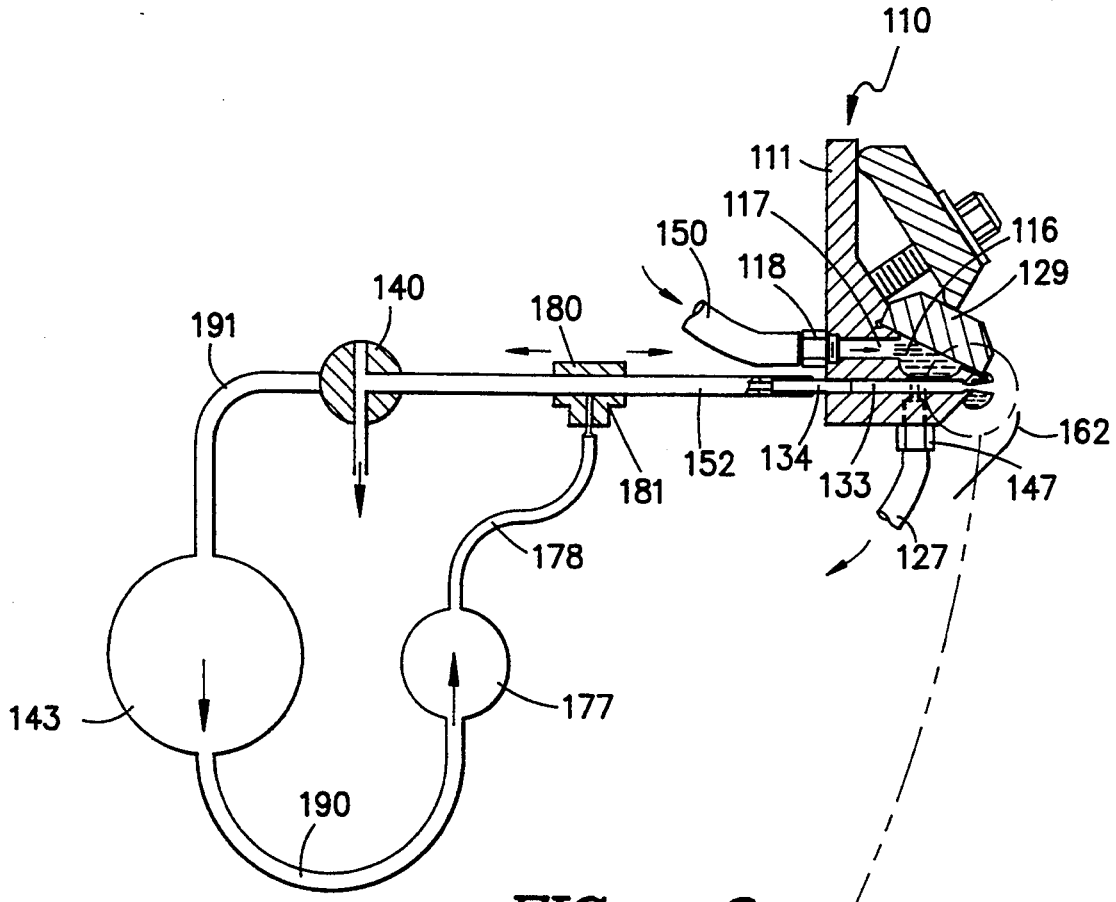
FIG. 3 is a cross section of the embodiment of FIG. 2, which shows a constant air flow system, through the air orifice while not patterning with liquid and while the dye stream is unstable.
Figure 3A:
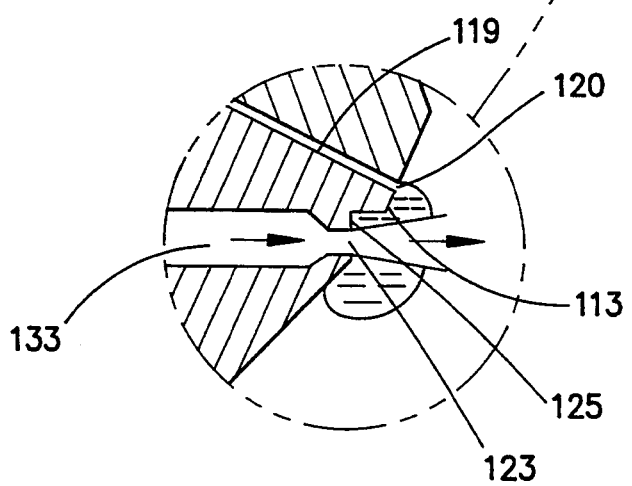
FIG. 3A shows a detail of FIG. 3 as indicated.
Figure 4:
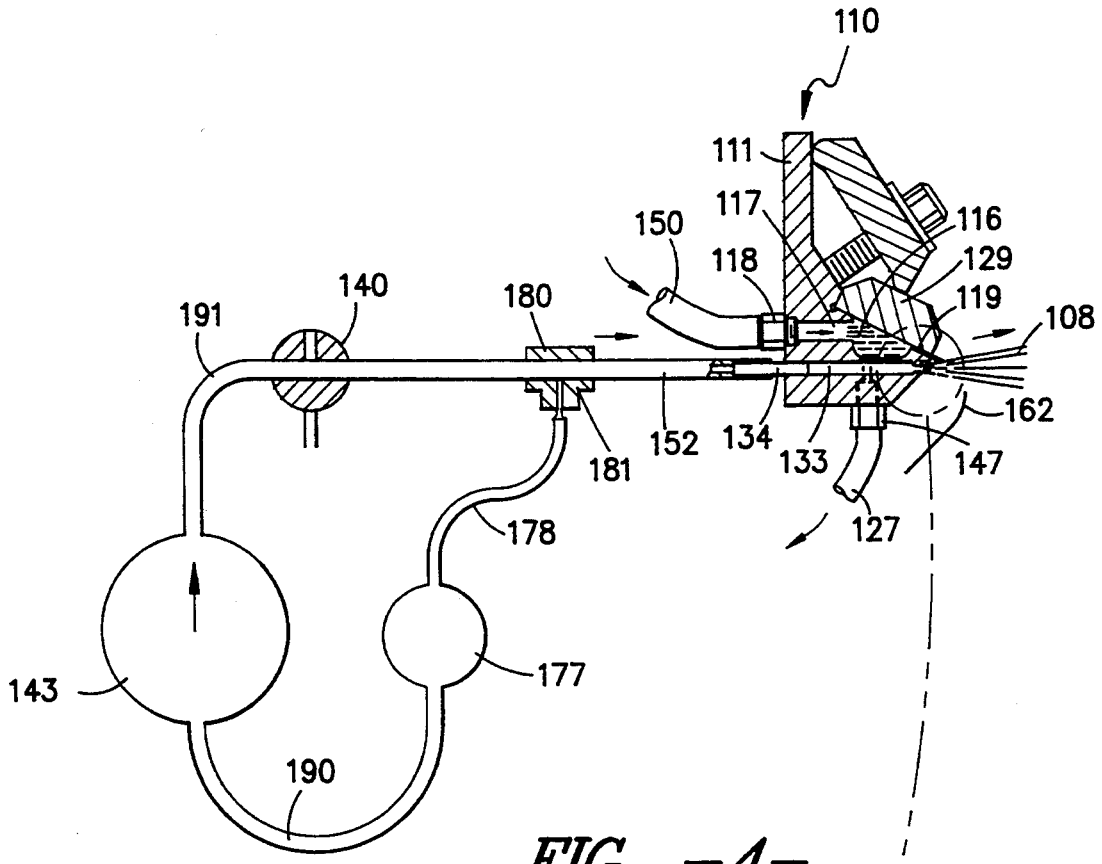
FIG. 4 is a cross section of the embodiment of FIG. 2 which shows a constant air flow system through the air orifice while patterning with liquid and with a stable dye stream.
Figure 4A:
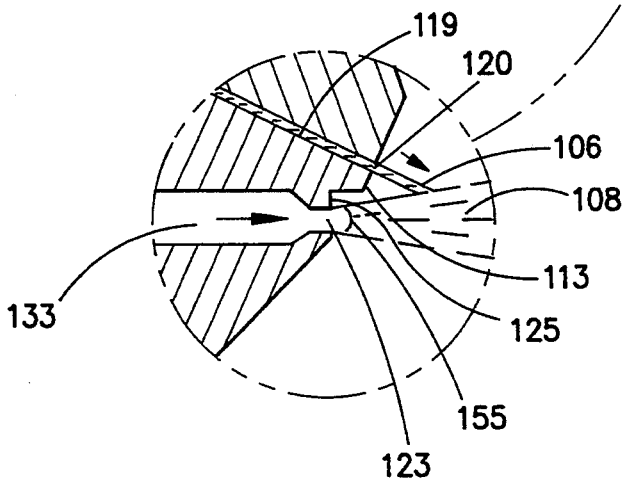
FIG. 4A shows a detail of FIG. 4 as indicated.
Figure 6:
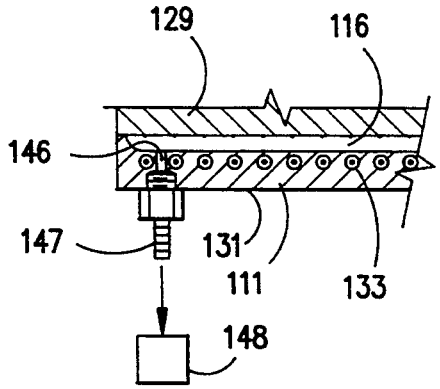
FIG. 6 is a cross-section of the embodiment of FIG. 2 taken along lines 6—6 of FIG. 7.

As shown in FIG. 6, dye bypass conduits 146 (each preferably having a diameter of 0.062 inch) extend from the trough 116 to the bottom surface 131 of the single piece module 110 originating from the trough 116 bottom, and is fitted with a dye return fitting 147 for connection to a dye return system 148 through dye return conduit 127, as shown in FIGS. 2, 3 and 4. As shown in FIGS. 3A and 4A, air exit orifices 123 are preferably longitudinally spaced along single piece module 110 at intervals of about 0.200 inch, with each air exit orifice 123 being paired with a corresponding dye groove 119 with both the groove 119 and the air orifice 123 lying in the same vertical plane. Each air orifice 123 is preferably drilled and reamed to a constant radius of curvature throughout its length of about 0.011 inches. Each air orifice 123 is in communication with air supply channel 133. Fitting 134 joins air line 152 to air supply passage 133. As can be seen in FIGS. 3A and 4A, the planar front surfaces 113 and 125 of single piece module 110 preferably have air orifices 123 and dye orifices 120 separated by approximately 0.10 inches.

Figure 5:
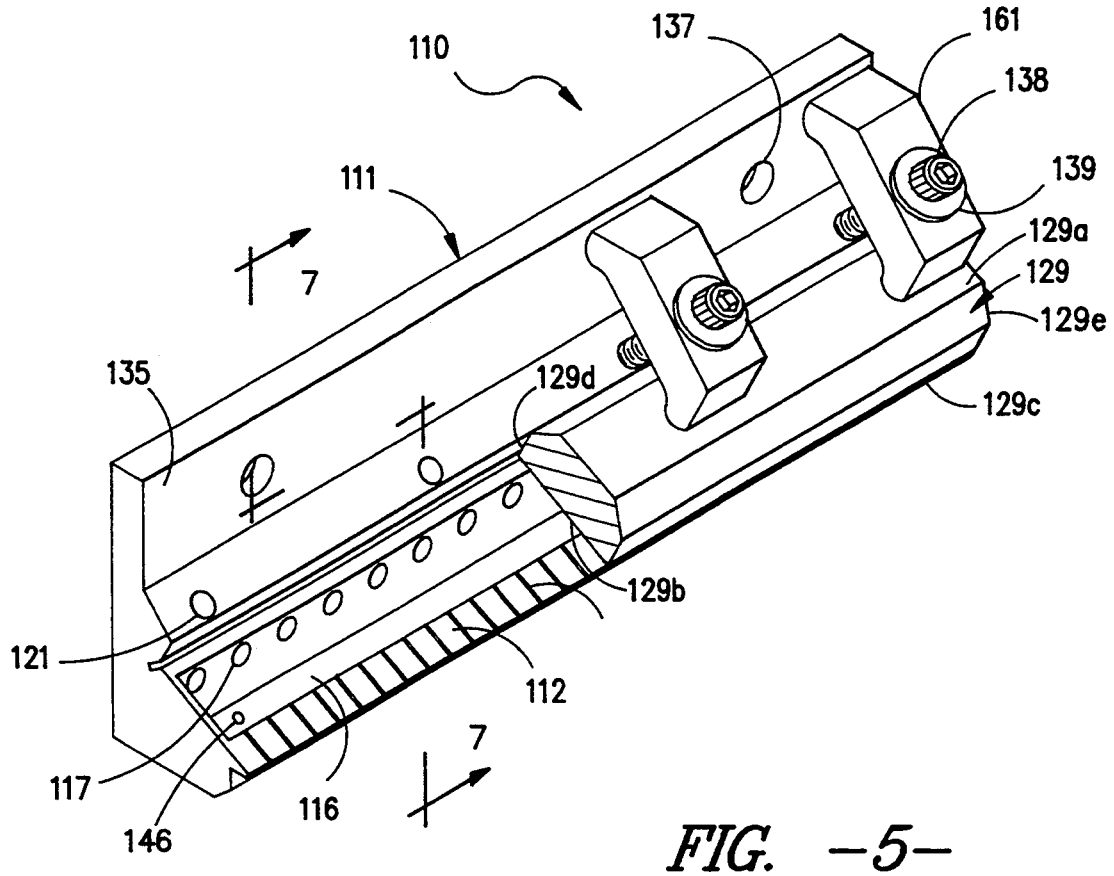
FIG. 5 depicts an embodiment of FIG. 2 in a perspective view in partial section, as viewed from above.

As shown in FIG. 5, the upper cover plate 129 is preferably a block of stainless steel, however any corrosion resistent metal, plastic, composite, and so forth will suffice. Upper cover plate 129 has a planar upper, lower, front, back and side surfaces as designated by numerals **129*a*, 129*b*, 129*c*, 129*d* and 129*e*, respectively. Mounting surface 135 is a planar front surface as shown in FIG. 5 and FIG. 7. A series of clamps 161 are arranged which interact with mounting surface 135. The module 110 is assembled by placing lower surface 129*b* of upper cover plate 129 on upper planar surface 112 of single piece module 110 such that the side surfaces 129*e* of the upper cover plate are flush with the side surfaces of single piece module 110 and such that the front surface 129*c* of the upper cover plate 129 is flush with front surface 113. Threaded bolt and washer assembly 138 are then placed through the clearance holes 130 in the clamps 161 and are threaded into the upper fastening holes 121. Mounting holes 137 (having clearance diameter 0.281 inch), extend through rear wall 111 of single piece module 110. Mounting clearance holes 137 are spaced to align with appropriately threaded holes associated with mounting fixtures on the apparatus in which the module 110 is used. Bolts 138 are tightened to cause clamps 161 to produce a liquid tight seal between the upper cover plate 129 and the upper surface 112 of single piece module 110, as shown in FIGS. 5 and 7. As an aid in creating a liquid tight seal the lower surface 129*b* of upper cover plate 129 is plated with a softer metal, typically gold or lead. Other materials could conceivably be used and parts of the upper planar surface 112** are sometimes plated with gold or lead.

Once assembled, single piece module 110 provides an array of dye conduits and air conduits for delivering dye and air through the module. The lower surface of upper cover plate 129 encloses dye grooves 119 to form covered dye conduits extending from trough 116 to dye orifice 120. A diverting lip or blade 162 is located between module 110 and moving substrate 10, in the path defined by dye grooves 119 (see FIGS. 3, 4, and 7). As best shown in FIG. 2, the dye or other marking material is delivered under pressure from dye supply manifold 142 is directed as a dye stream 106 toward diverting lip or blade 162. A catch trough 154 in communication with dye basin 160 is arranged in communication with the blade 162 to receive the liquid dye diverted by the blade 162 thereto. The dye collected in dye basin 160 is diverted through pipe reservoir 156 for reuse. The catch trough 154, dye basin 160 and pipe reservoir 156 constitute the previously referenced dye return system 148.

The assembled module 110 is used to spray patterns on a substrate. The module 110 is attached to a spraying machine that provides a pressurized dye source, a pressurized air source and means for selectively controlling the flow of air. The pressurized dye source, via manifold 142 and external dye conduit, is connected to dye supply fittings 118. Dye can then flow in a continuous path from the dye source, into trough 116, through the dye conduits formed by dye grooves 119 and out through dye orifices 120 and through the bypass conduits 146 into the dye return conduit system 148. The pressurized air source is connected to air supply fittings 134. When air flow is desired, air can flow in a continuous path from the air source 143, via fittings 164, air lines 152, fittings 134, air supply channels 133 and out through air exit orifices 123.

The operation of a spraying apparatus employing a module of the present invention can be described by considering the operation of a single air conduit/dye conduit pair and with reference to FIGS. 3, 3A, 4, 4A and 7. An air control valve 140 associated with the pressurized air source 143 prevents air from flowing through air conduit 191 to air supply fitting 134. Dye is continuously supplied by pressurized dye source 142 to dye supply fitting 118 and flows out dye orifice 120. The dye stream emanating from dye orifice 120 flows unimpeded into the surface of diverting lip or blade 162, which collects the dye in catch trough 154 for disposal or recirculation to dye basin 160 and then to the pipe reservoir 156 as part of the dye return system 148.

When dye from the dye stream is to be applied to the substrate 10, pulses of air generated by the opening and closing of the air control valve 140 are supplied from the pressurized air source 143 to air supply fitting 134. The air stream emanating from air exit orifice 123 impinges the dye stream, disrupting the regular flow of dye. As shown in the detail of FIG. 4A, the dye orifice 120 and air orifice 123 are positioned such that the dye is contacted with air after it exits from the dye orifice 120. As a result of the interaction of the higher pressure air stream (e.g., 20–40 p.s.i.g.) with the lower pressure dye stream (e.g., 2–4 p.s.i.g.) the dye stream is broken up into a spray of diverging droplets 108. The combined momentum of the two streams then carries the droplets to the surface of the substrate 10. Because the dye exits the dye orifice 120 outside of the airstream envelope 155, aspiration of dye from the dye supply conduit is eliminated, thereby eliminating the need to create uniform aspiration across the width of the module 110 as shown in FIG. 4A. To achieve the desired dying pattern, air control valves 140 for each conduit pair can be selectively opened and closed separately or in combinations according to pattern information supplied by controller 141, as shown in FIG. 2.

Two general dye flow streams exist in trough 116, as shown in FIG. 5 and 6. One stream (the supply stream) flows from the exit of each dye supply conduit 117 to the entrance of each dye conduit formed by dye groove 119. The second flow stream (the bypass steam) flows from the exit of each dye supply conduit 117 to the entrance of each dye bypass conduit 146. In the undesirable event that a solid contaminant lodges itself at the entrance to a dye conduit formed by dye groove 119, thus restricting dye flow through that dye conduit, it can easily be pushed away from the dye conduit entrance and out of the supply stream and into the bypass stream by inserting a properly sized wire into the conduit from the orifice 120. The solid contaminant would then exit the trough 116 by way of bypass conduit 146, through the dye return fittings 147 and into the dye return system 148 where it will be removed through filtration.

Additional information relating to the operation of such a spraying apparatus, including more detailed description of patterning and control functions, can be found in coassigned. U.S. Pat. No. 4,923,743, which is incorporated by reference as if fully set forth herein.

Variations in dye delivery onto a substrate using the module of the present invention (as shown in FIGS. 1 through 4A) and an array of separately manufactured and assembled components, as previously described and disclosed in coassigned U.S. Pat. No. 4,923,743, were compared. The maximum misalignment of the dye and air orifices in the latter apparatus was found to be 0.007 inch. The dye orifices in that apparatus were spaced 0.400 inch from each other and during dyeing the substrate was located 3–8 inches from the dye orifice. The relative angle between the air and dye streams is 26 degrees. Because of misdirectivity in the dye flow this angle varied from 22.5 to 29.5 degrees. This difference in relative angle varies the length of the dye stream in the diverging air stream. More specifically, the dye path length is 0.37 inches and 0.68 inches for the angles of 29.5 degrees and 22.5 degrees respectively. The length of dye stream in the air stream is atomized and deposited on the substrate. Because of the varying lengths of the dye stream in the air stream, a varying amount of dye is atomized and deposited on the substrate. This creates a visually obvious streak in the dye pattern.

In contrast, single piece module 110 has a relative angle between the air and dye stream in the range of 25.5–26.5 degrees. The dye stream lengths in the air stream are 0.458 inches and 0.499 inches for angles of 25.5 degrees and 26.5 degrees, respectively. Additionally, the maximum misalignment of the dye and air orifices is 0.001 inches. The preceding material represents the preferred parameters, while significant deviations therefrom are functionally possible.

Due to the minimal amount of dye stream length variation and misalignment, the present invention provides means for producing very precise and uniform spray pattern applications. The single piece module 110 is also non-adjustable and tamper proof, thereby providing an added advantage for extended commercial production. The efficiency of dye deposition on the substrate is also improved by the configuration of the present invention, wherein the dye orifice 120 is not in the air stream. As shown in FIG. 4, the dye orifice 120 is positioned substantially outside the air stream envelope 155. This configuration maximizes the dye stream length that is positioned within the air stream envelope 155, and thereby atomized and carried by the air stream in the form of dye spray 108 to the substrate 10.

One problem with this system, as shown in FIGS. 2, 3, 3A, 4, and 4A, is that dye or other liquid marking material can wick into the air orifice 123 when the dye dabbles down the face of the module 10. This occurs only when the dye speed through the dye orifice 123 is too slow to maintain a stable dye stream 106. Low dye flow occurs at start-up, shut-down or whenever the dye orifice 123 is partially plugged. Stable, high speed, dye flow is shown in FIGS. 4, 4A and 7. As shown in FIGS. 2, 3, and 4, there is a constant air flow manifold 177 that preferably provides constant air flow of 24 p.s.i.g. when the air control valve 140 is closed thereby cutting off the air manifold source 143 from the single piece module 110 via air conduit 191, as shown in FIG. 3. When there is air pressure in the air manifold source 143, then there will be air pressure in the constant air flow manifold 177. This constantly flowing air exits the constant air flow manifold 177 by means of exit tubes 178. There are four hundred (400) exit tubes 178 on each constant air flow manifold 177 in the preferred embodiment. At the end of each exit tube 178 is a tee-connection 180 that has a precision orifice restrictor 181, as shown in FIGS. 3 and 4. The precision orifice restrictor 181 has a 0.0063 inch diameter for two gunbars and a 0.0067 inch diameter for the remaining three gunbars in the preferred embodiment. The tee-connection 180 is attached to the air conduit 152 between the air control valve 140 and the single piece module 110. The precision orifice restrictors serve two functions. The first function is to restrict the air flow out of the air orifice 123 to the point where the stream of air is low enough not to affect the dye stream 106, but high enough to prevent dye from entering the air orifice 123 in the single piece module 110, as shown in FIGS. 4 and 7. If the air pressure is too high, it will divert the dye stream 106 over the top of the diverting lip or blade 162 and onto the substrate 10. Even a partial diversion of the dye stream must be avoided. This is shown in FIG. 4, in which the air flow from the air manifold source primarily exits through air control valve 140 to the air orifice 123, while a secondary air flow goes through the constant air flow manifold 177 at 24 p.s.i.g. and through the tee-connection 180 into air conduit 152 to join the primary air flow and also exit out of air orifice 123. It is important to have a higher air pressure in the exit tubes 178 than in the air conduit 152 in order to prevent air from flowing back into the tee-connection 180 and into the constant air flow manifold 177 and wasting air during the printing burst. The air control valve 140 only opens to deliver a burst of air to the single piece module 110 when printing. As shown in FIGS. 3 and 4, there is a flow tube 190 that connects the air manifold source 143 to the constant flow manifold 177. There is a flow tube 191 that connects the air manifold source 143 to the air control valve 140. The other side of the air control valve 140 is connected to air conduit 152 upon which precision orifice restrictor 181 is tee-connected thereto.

Referring now to FIG. 3, the operation of this system when the air control valve 140 is closed is that air exits the air manifold source 143 and passes through the flow tube 190 into the constant air flow manifold 177 and sends air into the precision orifice restrictor 181 that is part of the tee-connection 180. From the tee-connection the air flows in two directions. The first direction is back to the closed air control valve 140 which releases air into the valve house 200 via exhaust ports 145 communicating with the air control valves 140, as shown in FIG. 2. This release of air into the valve house 200 provides a benefit by surrounding the valves and associated electronic circuitry with clean filtered air that prevents dye laden air or other contaminants from entering the valve house 200 and causing the electrical and electronic circuitry to malfunction. The second direction is through air conduit 152 into single piece module 110 and out through air orifice 123. When the air pressure in the manifold source 143 is 35 p.s.i.g. the corresponding air pressure in the constant air flow manifold 177 is 24 p.s.i.g. When sixty (60) single piece modules 110 are utilized under this condition, seventy six and one-half (76.5) standard cubic feet per minute (scfm) of air is delivered through the exit tubes 178 to the tee-connections 180. Twenty-six percent (26%) of this air (19.9 scfm) passes through the single piece module 110 and out the air orifice 123. The remaining seventy-four percent (74%) (56.6 scfm) flows through the air control valve 140 to distribute air throughout the valve house 200. These standard cubic feet per minute flow values are based on an operating pressure in the air manifold source of 35 p.s.i.g., which is only the preferred value. Other operating pressures will create different flows. When the control valve 143 is closed, then no air will flow through flow tube 191.

Referring now to FIG. 4, the operation of this system when the air control valve 140 is open is that air exits the air source 143 in two directions. The first direction is through the flow tube 190 into the constant air flow manifold 177 and into the precision orifice restrictor 181 that is part of the tee-connection 180 for directing the air through air conduit 152 into single piece module 110 and out of air orifice 123. The second direction of air travel is into flow tube 191 through open air control valve 140 into air conduit 152 that intersects tee-connection 180 and then into single piece module 110 and out of air orifice 123. It is readily apparent the air flow in both directions merge at the tee-connection 180 for combined flow into the single piece module 110 with most of the air flow passing through the air control valve 140.

The vertical stacking of rows of single piece modules 110 that make up an array of spray generators 100 creates a problem of dye mist forming droplets contaminating the substrate 10 or other parts of the array 100. A solution to this problem is the utilization of drip shields to provide protection. As shown in FIG. 2, there is a top shield 170 that acts as a roof and keeps dirty contaminated dye from dripping onto that row of single piece modules 110 and the dye supply manifold 142 and into the dye return system 148. There are three representations of top shield 170 present in FIG. 2, with one for every row of twelve single piece modules 110 present in the array 100. There are five rows of twelve single piece modules that make up the array 100. Dye collects in the trough 173 for top shield 170 and flows out each end beyond the edges of the fabric and array 100 thereby avoiding any contamination of the fabric or the single piece modules 110 located directly below or the dye return system 148 located directly below. There is a middle shield 171 extending between an ell-shaped support member 195, upon which the dye supply manifold 142 is attached, and a row of twelve single piece modules 110 is attached. Middle shield 171 has an upper trough 185 that collects dye that runs off the top shield 170 and a lower trough 186 that collects dye that runs off the flat sloped portion 168 of middle shield 171. Both upper trough 185 and lower trough 186 drain out both ends beyond the row of single piece modules 110 in array 100 and beyond the edges of the substrate 10 and draining into the dye return system 148, thereby avoiding any contamination of the substrate 10. Bottom shield 172 is mounted to and follows the contours of the second diverting lip or blade 163 that is attached to the catch trough 154. This bottom shield 172 deflects dye away from the substrate 10 so that it can drip onto the top shield 170 of the next lower row of single piece modules 110. It is located between the second diverting lip or blade 163 and associated catch trough 154 and the substrate 10. In summary, these drip shields 170, 171 and 172 allow the mist to collect and form into larger drops that eventually run to the lowest point on the shield. Furthermore, the drip shields 170, 171 and 172 are shaped and positioned such that the running dye drops adhere to the shields until they reach the lowest point and at the lowest point the dye either fills any of the three troughs and flows harmlessly out the print zone, i.e., beyond the edges of the row of single piece modules 110, where they then drip onto the floor or into the pipe reservoir 156 for recirculation or the dye drips to the next lower row of single piece module's 110 top shield 170 at a distance from the substrate 10 that prevents the resulting splatter from reaching the substrate 10.

From the foregoing, it will be apparent to those skilled in the art that various modifications in the above described devices can be made without departing from the spirit and scope of the invention. Accordingly the invention may be embodied in other specific forms without departing from the spirit or essential characteristics thereof. Present embodiments, therefore, are to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method of dyeing a substrate positioned in front of a spray of liquid marking material, said spray being formed by a means that interacts a stream of liquid marking material and a stream of pressurized control fluid; said method comprising the steps of projecting a plurality of discrete, substantially continuous liquid streams of a marking material along a path which precludes contact with said substrate, forming at least one pressurized dispersing stream of a pressurized control fluid, said dispersing stream being projected in an expanding trajectory directed at said substrate and being oriented to provide for the intersection of said dispersing stream with at least one respective liquid marking stream, said dispersing stream having sufficient lateral width at the location of intersection with at least one liquid marking stream to envelope laterally respective stream of marking material a shower of diverging droplets of said marking material and to project at least a portion of said diverging droplets onto said substrate, said pressure associated with said dispersing stream being rapidly modulated so as to form from said continuous stream of a series of spaced discrete bursts of droplets directed at said substrate, each burst containing a controlled quantity of marking material, and thereby meter a controllable quantity of marking material onto said substrate at a rate determined by the frequency and duration of said bursts, and moving said substrate to a position which brings a portion of said substrate in contact with a portion of said shower of droplets and diverting said shower of droplets which do not initially strike said substrate away from at least one of said substrate and said interaction means.

2. A method of dyeing a substrate positioned in front of a spray of liquid marking material, said spray being formed by a means that interacts a stream of liquid marking material and a stream of pressurized control fluid as defined in claim 1, wherein said step of diverting said shower of droplets which do not initially strike said substrate further comprises deflecting said shower of droplets by a plurality of shields.

3. A method of dyeing a substrate positioned in front of a spray of liquid marking material, said spray being formed by a means that interacts a stream of liquid marking material and a stream of pressurized control fluid as defined in claim 1, wherein said step of diverting said shower of droplets which do not initially strike said substrate further comprises deflecting said shower of droplets by a stream of pressurized fluid directed through an outlet of a conduit utilized by said pressurized control fluid.

4. A method of dyeing a substrate positioned in front of a spray of liquid marking material, said spray being formed by a means that interacts a stream of liquid marking material and a stream of pressurized control fluid as defined in claim 1, wherein said step of diverting said shower of droplets which do not initially strike said substrate further comprises deflecting said shower of droplets by a stream of pressurized fluid directed through an outlet of a conduit utilized by said pressurized control fluid and by a plurality of shields.

5. A method of dyeing a substrate positioned in front of a spray of liquid marking material, said spray being formed by a means that interacts a stream of liquid marking material projecting from a first conduit having an inlet and outlet and a stream of pressurized control fluid from a second conduit having an inlet and outlet; said method comprising the steps of projecting a plurality of discrete, substantially continuous liquid streams of a marking material along a path which precludes contact with said substrate, forming at least one pressurized dispersing stream of a pressurized control fluid, said dispersing stream being projected in an expanding trajectory directed at said substrate and being oriented to provide for the intersection of said dispersing stream with at least one respective liquid marking stream, said dispersing stream having sufficient lateral width at the location of intersection with at least one liquid marking stream to envelope laterally respective stream of marking material a shower of diverging droplets of said marking material and to project at least a portion of said diverging droplets onto said substrate, said pressure associated with said dispersing stream being rapidly modulated so as to form from said continuous stream a series of spaced discrete bursts of droplets directed at said substrate, each burst containing a controlled quantity of marking material, and thereby meter a controllable quantity of marking material onto said substrate at a rate determined by the frequency and duration of said bursts, and moving said substrate to a position which brings a portion of said substrate in contact with a portion of said shower of droplets and diverting said shower of droplets which do not initially strike said substrate away from at least one of said substrate and said interaction means by providing a stream of pressurized fluid through said second conduit to prevent clogging thereof.

6. A method of dyeing a substrate positioned in front of a spray of liquid marking material, said spray being formed by a means that interacts a stream of liquid marking material and a stream of pressurized control fluid as defined in claim 5, wherein said step of diverting said shower of droplets which do not initially strike said substrate further comprises deflecting said shower of droplets from said outlet of said second conduit by means of a third conduit having a first end portion and a second end portion, said first end portion of said third conduit is connected to a source of said pressurized control fluid and said second end portion of said first conduit is connected to a manifold means, a fourth conduit having a first end portion and a second end portion, said first end portion of said fourth conduit is connected to said manifold means and said second end portion of said fourth conduit is operatively connected to said inlet of said second conduit.

7. A method of dyeing a substrate positioned in front of a spray of liquid marking material, said spray being formed by a means that interacts a stream of liquid marking material and a stream of pressurized control fluid as defined in claim 5, wherein said step of providing a stream of pressurized control fluid through said second conduit to prevent clogging thereof further comprises the step of restricting said flow of pressurized fluid.

8. A method of dyeing a substrate positioned in front of a spray of liquid marking material, said spray being formed by a means that interacts a stream of liquid marking material and a stream of pressurized control fluid as defined in claim 5, wherein said step of diverting said shower of droplets which do not initially strike said substrate further comprises deflecting said shower of droplets from said outlet of said second conduit by means a third conduit having a first end portion and a second end portion, said first end portion of said third conduit is connected to a source of said pressurized control fluid and said second end portion of said first conduit is connected to a manifold means, a fourth conduit having a first end portion and a second end portion, said first end portion of said fourth conduit is connected to said manifold means and said second end portion of said fourth conduit is connected to a restricting means, said restricting means is operatively connected to said inlet of said second conduit.

9. A method of dyeing a substrate positioned in front of a spray of liquid marking material, said spray being formed by a means that interacts a stream of liquid marking material and a stream of pressurized control fluid; said method comprising the steps of projecting a plurality of discrete, substantially continuous liquid streams of a marking material along a path which precludes contact with said substrate, forming at least one pressurized dispersing stream of a pressurized control fluid, said dispersing stream being projected in an expanding trajectory directed at said substrate a being oriented to provide for the intersection of said dispersing stream with at least one respective liquid marking stream, said dispersing stream having sufficient lateral width at the location of intersection with at least one liquid marking stream to envelope laterally respective stream of marking material a shower of diverging droplets of said marking material and to project at least a portion of said diverging droplets onto said substrate, said pressure associated with said dispersing stream being rapidly modulated so as to form from said continuous stream of a series of spaced discrete bursts of droplets directed at said substrate, each burst containing a controlled quantity of marking material, and thereby meter a controllable quantity of marking material onto said substrate at a rate determined by the frequency and duration of said bursts, and moving said substrate to a position which brings a portion of said substrate in contact with a portion of said shower of droplets and diverting said shower of droplets which do not initially strike said substrate away from said substrate and said interaction means by means of a first liquid marking material shield having a first trough means for diverting said liquid marking material away from said substrate mounted above said interaction means.

10. A method of dyeing a substrate positioned in front of a spray of liquid marking material, said spray being formed by a means that interacts a stream of liquid marking material and a stream of pressurized control fluid as defined in claim 9, wherein said step of diverting said shower of droplets which do not initially strike said substrate further comprises a second liquid marking material shield mounted transverse to said first liquid marking material shield and having a second trough means and a third trough means for diverting said liquid marking material away from said substrate.

11. A method of dyeing a substrate positioned in front of a spray of liquid marking material, said spray being formed by a means that interacts a stream of liquid marking material and a stream of pressurized control fluid as defined in claim 9, wherein said step of diverting said shower of droplets which do not initially strike said substrate further comprises a third liquid marking material shield mounted transverse to said second liquid marking material shield for diverting liquid marking material away from said substrate.

12. A method of dyeing a substrate positioned in front of a spray of liquid marking material, said spray being formed by a means that interacts a stream of liquid marking material and a stream of pressurized control fluid; said method comprising the steps of projecting a plurality of discrete, substantially continuous liquid streams of a marking material along a path which precludes contact with said substrate, forming at least one pressurized dispersing stream of a pressurized control fluid, said dispersing stream being projected in an expanding trajectory directed at said substrate and being oriented to provide for the intersection of said dispersing stream with at least one respective liquid marking stream, said dispersing stream having sufficient lateral width at the location of intersection with at least one liquid marking stream to envelope laterally respective stream of marking material a shower of diverging droplets of said marking material and to project at least a portion of said diverging droplets onto said substrate, said pressure associated with said dispersing stream being rapidly modulated so as to form from said continuous stream of a series of spaced discrete bursts of droplets directed at said substrate, each burst containing a controlled quantity of marking material, and thereby meter a controllable quantity of marking material onto said substrate at a rate determined by the frequency and duration of said bursts, and moving said substrate to a position which brings a portion of said substrate in contact with a portion of said shower of droplets and diverting said shower of droplets which do not initially strike said substrate away from at least one of said substrate and said interaction means by a first liquid marking material shield having a first trough means for diverting said liquid marking material away from said substrate mounted above said interaction means, a second liquid marking material shield mounted transverse to said first liquid marking material shield and having a second trough means and a third trough means for diverting said liquid marking material away from said substrate and a third liquid marking material shield mounted transverse to said second liquid marking material shield for diverting liquid marking material away from said substrate.

13. A method of dyeing a substrate positioned in front of a spray of liquid marking material, said spray being formed by a means that interacts a stream of liquid marking material and a stream of pressurized control fluid; said method comprising the steps of projecting a plurality of discrete, substantially continuous liquid streams of a marking material along a path which precludes contact with said substrate, forming at least one pressurized dispersing stream of a pressurized control fluid, said dispersing stream being projected in an expanding trajectory directed at said substrate and being oriented to provide for the intersection of said dispersing stream with at least one respective liquid marking stream, said dispersing stream having sufficient lateral width at the location of intersection with at least one liquid marking stream to envelope laterally respective stream of marking material a shower of diverging droplets of said marking material and to project at least a portion of said diverging droplets onto said substrate, said pressure associated with said dispersing stream being rapidly modulated so as to form from said continuous stream of a series of spaced discrete bursts of droplets directed at said substrate, each burst containing a controlled quantity of marking material, and thereby meter a controllable quantity of marking material onto said substrate at a rate determined by the frequency and duration of said bursts, and moving said substrate to a position which brings a portion of said substrate in contact with a portion of said shower of droplets and diverting said shower of droplets which do not initially strike said substrate away from at least one of said substrate and said interaction means by the step of discharging pressurized fluid from a bypass means in a valve means that controls the flow of pressurized control fluid thereby diverting marking material mist.

* * * * *

UNITED STATES PATENT AND TRADEMARK OFFICE

CERTIFICATE OF CORRECTION

PATENT NO. : 5,367,733

DATED : November 29, 1994

INVENTOR(S) : Berhard Zeiler

It is certified that error appears in the above-indentified patent and that said Letters Patent is hereby corrected as shown below:

Column 12, Line 37 delete "a" and replace with - and -

Signed and Sealed this

Eighth Day of April, 1997

*Attest:*

*Attesting Officer*

BRUCE LEHMAN

*Commissioner of Patents and Trademarks*